US010836021B2

(12) United States Patent
Rosenberger

(10) Patent No.: US 10,836,021 B2
(45) Date of Patent: Nov. 17, 2020

(54) ASSEMBLY TOOL COMPRISING A MARKING FUNCTION AND METHOD FOR FORMING MARKINGS IN FASTENING ELEMENTS BY MEANS OF AN ASSEMBLY TOOL

(71) Applicant: Bayerische Motoren Werke Aktiengesellschaft, Munich (DE)

(72) Inventor: Maximilian Rosenberger, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 8 days.

(21) Appl. No.: 15/683,048

(22) Filed: Aug. 22, 2017

(65) Prior Publication Data

US 2017/0348837 A1 Dec. 7, 2017

Related U.S. Application Data

(63) Continuation of application No. PCT/EP2016/054195, filed on Feb. 29, 2016.

(30) Foreign Application Priority Data

Mar. 19, 2015 (DE) ..... 10 2015 204 979

(51) Int. Cl.
*B25B 23/15* (2006.01)
*B25B 23/147* (2006.01)

(52) U.S. Cl.
CPC ..... *B25B 23/15* (2013.01); *B25B 23/147* (2013.01)

(58) Field of Classification Search
CPC ..... B25B 23/1422; B25B 23/1427; B25B 23/143; B25B 23/15; F16B 31/02; F16B 23/0061; A61J 1/2055
See application file for complete search history.

(56) References Cited

U.S. PATENT DOCUMENTS 1,349,201 A 8/1920 Hitchcock
3,472,102 A * 10/1969 Komsa ..... B25B 23/15 81/468
3,486,402 A * 12/1969 Komsa ..... B25B 23/15 81/468

(Continued)

FOREIGN PATENT DOCUMENTS

CN 101835566 A 9/2010
CN 102762094 A 10/2012

(Continued)

OTHER PUBLICATIONS

German Search Report issued in counterpart German Application No. 10 2015 204 979.5 dated Jan. 18, 2016 with partial English-language translation (ten (10) pages).

(Continued)

*Primary Examiner* — David B. Thomas
(74) *Attorney, Agent, or Firm* — Crowell & Moring LLP

(57) ABSTRACT

An assembly tool is provided for connecting a fastening element to at least one component. The assembly tool has a marking device, which is designed to apply a first type of marking to a fastening element when a first connecting step is finished, and to apply a second type of marking to a fastening element when a second connecting step is finished.

17 Claims, 2 Drawing Sheets

(56) References Cited

U.S. PATENT DOCUMENTS

| | | | | | |
|---|---|---|---|---|---|
| 3,802,301 | A * | 4/1974 | Peterson | B25B 23/145 | 81/468 |
| 3,918,609 | A * | 11/1975 | Peterson | B25B 23/15 | 222/61 |
| 4,275,652 | A * | 6/1981 | Bo | B44B 5/026 | 101/4 |
| 4,712,473 | A * | 12/1987 | Amos | B44B 5/026 | 101/29 |
| 4,759,237 | A * | 7/1988 | Fauchet | B25B 13/065 | 29/437 |
| 5,256,014 | A * | 10/1993 | Wing | B25B 13/065 | 29/407.02 |
| 5,282,707 | A * | 2/1994 | Palm | F16B 31/02 | 29/407.02 |
| 7,721,631 | B2 * | 5/2010 | Berg | B25B 23/15 | 73/862.21 |
| 8,590,429 | B2 * | 11/2013 | Goss | B25B 13/065 | 81/55 |
| 9,199,364 | B2 * | 12/2015 | Ito | B25B 23/15 | |
| 9,393,679 | B2 * | 7/2016 | Kim | B25B 23/14 | |
| 2006/0263143 | A1 * | 11/2006 | Tseng | B43K 23/08 | 401/195 |
| 2011/0048182 | A1 | 3/2011 | Goss et al. | | |

FOREIGN PATENT DOCUMENTS

| | | | |
|---|---|---|---|
| DE | 25 30 077 | | 2/1977 |
| DE | 81 34 888 | U1 | 4/1982 |
| DE | 84 11 182 | U1 | 7/1984 |
| DE | 37 44 362 | A1 | 12/1988 |
| DE | 42 31 265 | A1 | 3/1994 |
| DE | 37 51 299 | T2 | 9/1995 |
| DE | 201 17 855 | U1 | 3/2003 |
| DE | 10 2008 034 559 | A1 | 4/2009 |
| EP | 0 080 564 | A2 | 6/1983 |
| FR | 2 970 200 | B1 | 12/2013 |
| GB | 1 349 201 | A | 4/1974 |
| JP | 2003-340742 | A | 12/2003 |
| WO | WO 87/05977 | A1 | 10/1987 |
| WO | WO 2011/087405 | A1 | 7/2011 |
| WO | WO 2014/079604 | A1 | 5/2014 |

OTHER PUBLICATIONS

International Search Report (PCT/ISA/210) issued in PCT Application No. PCT/EP2016/054195 dated May 24, 2016 with English-language translation (five (5) pages).

German-language Written Opinion (PCT/ISA/237) issued in PCT Application No. PCT/EP2016/054195 dated May 24, 2016 (six (6) pages).

Chinese-language Office Action issued in counterpart Chinese Application No. 201680004006.3 dated Jun. 6, 2018 with English translation (19 pages).

"Torque-Marking Tool", IBM Technical Disclosure Bulletin, International Business Machines Corp., Jul. 1, 1988, pp. 4-5, vol. 31, No. 2, XP000051096, two pages.

* cited by examiner

Fig. 3

| A | B | C | D | |
|---|---|---|---|---|
| 0 | 0 | 0 | 0 | 0 |
| 0 | 0 | 0 | 1 | 1 |
| 0 | 0 | 1 | 0 | 2 |
| 0 | 0 | 1 | 1 | 3 |
| 0 | 1 | 0 | 0 | 4 |
| 0 | 1 | 0 | 1 | 5 |
| 0 | 1 | 1 | 0 | 6 |
| 0 | 1 | 1 | 1 | 7 |
| 1 | 0 | 0 | 0 | 8 |
| 1 | 0 | 0 | 1 | 9 |
| 1 | 0 | 1 | 0 | 10 |
| 1 | 0 | 1 | 1 | 11 |
| 1 | 1 | 0 | 0 | 12 |
| 1 | 1 | 0 | 1 | 13 |
| 1 | 1 | 1 | 0 | 14 |
| 1 | 1 | 1 | 1 | 15 |

ASSEMBLY TOOL COMPRISING A MARKING FUNCTION AND METHOD FOR FORMING MARKINGS IN FASTENING ELEMENTS BY MEANS OF AN ASSEMBLY TOOL

CROSS REFERENCE TO RELATED APPLICATIONS

This application is a continuation of PCT International Application No. PCT/EP2016/054195, filed Feb. 29, 2016, which claims priority under 35 U.S.C. § 119 from German Patent Application No. 10 2015 204 979.5, filed Mar. 19, 2015, the entire disclosures of which are herein expressly incorporated by reference.

BACKGROUND AND SUMMARY OF THE INVENTION

An assembly tool which has a marking function is specified. The assembly tool can be embodied as a screwdriver tool, for example. Furthermore, an assembly device having an assembly tool, and a method for forming markings in fastening elements by means of an assembly tool are specified.

Assembly tools in the case of which, upon reaching a predefined torque, a marking is applied to a fastening element in order for correct fastening of the fastening element to be documented are known in the prior art.

For example, DE 8 411 182 U1 describes a torque wrench having a marking device in which case, upon reaching the set torque, an impulse generator controls a serrated tooth such that the latter provides a notch on the screw head or on the nut, respectively.

Furthermore, a torque wrench in which case, upon reaching the predefined torque, a marking device that is configured as a paint spray gun applies a paint spray jet through the screwdriver tool socket onto the screw, is known from publication DE 8 134 888 U1.

Furthermore, there are networked assembly tools which document the number of assembled fastening elements and the terminal torques attained.

In the case of manual assembly by use of an assembly tool, according to the prior art the assembly sequence is predefined by a written work order to the operator. Once the assembly procedure has been completed, it is, however, no longer possible to retroactively establish whether the correct assembly sequence has been adhered to.

It is an object to be achieved by at least some embodiments to provide an assembly tool having a marking function by which the assembly sequence can also be retroactively established in the case of the assembly of a multiplicity of fastening elements. Further objects of at least some embodiments are to provide an assembly device having an assembly tool and a method for forming markings in fastening elements by use of an assembly tool.

These and other objects are achieved by an assembly tool in accordance with embodiments of the invention.

An assembly tool for connecting fastening elements to at least one component, according to at least one embodiment, has a marking device. The assembly tool can be configured as a screwdriver tool, for example. The assembly tool is preferably a manually guided assembly tool such as, for example, a hand-held screwdriver. The fastening elements can be screws, for example, such as hexagonal flange screws, for example.

The marking device of the assembly tool is configured for providing a fastening element with a first type of marking upon completion of a first connection procedure. The completion of the connection procedure can be defined, for example, by reaching a predefined parameter, or by reaching a predefined nominal value, respectively. The term "upon completion" herein can refer to a point in time exactly upon completion of the connection procedure, or to a point in time immediately post completion of the connection procedure. The marking device of the assembly tool is furthermore configured for providing a second fastening element that is employed in a second connection procedure with a second type of marking upon completion of the second connection procedure which is preferably performed post completion of the first connection procedure. The marking of the first type preferably differs from the marking of the second type. For example, the marking of the first type in terms of the size, shape, depth, color, and/or position thereof can differ from the marking of the second type.

According to a further embodiment, providing the fastening elements with the markings is performed in a fully automated manner. This can mean, in particular, that the fastening elements upon reaching a predefined parameter or nominal value, respectively, are marked in a fully automated manner by the marking device, without any manual activation of the marking device being performed. Furthermore, it is in particular not necessary for the marking device to be manually adapted between providing a fastening element with the first type of marking and providing a fastening element with the second type of marking, in order for a changeover from the first type of marking to the second type of marking to be enabled.

According to a further embodiment, the marking device is connected to a control unit by which the marking device is controlled. The control unit, in terms of program technology, can be connected to an assembly line, wherein items of information, for example at the commencement of a new series of screw connections, can be transmitted from the assembly line by way of the control unit to the marking device.

According to a further embodiment, the marking device, upon completion of a further connection procedure which immediately follows the second connection procedure, is configured to provide a fastening element with a further type of marking which preferably differs from the first type of marking and from the second type of marking. The marking device, upon completion of a multiplicity of further connection procedures which follow the second connection procedure, is particularly preferably configured for generating a multiplicity of further types of markings.

According to one further embodiment, providing the markings is performed by means of shape cutting, such as cutting by turning and/or milling, for example. Alternatively or additionally, providing the markings can also be performed by machining via a laser beam.

According to a further embodiment, providing the markings is performed by applying a marking indicator. Paint and/or lacquer can be applied to the fastening element or to the fastening elements, respectively, by way of the marking device, for example. The marking indicator can be applied to the fastening elements by way of a printing method, for example, such as pad printing, for example.

According to a further embodiment, the various types of markings differ in terms of the size thereof. For example, a marking can be applied to the fastening elements by way of the marking device in such a manner that the markings that are generated in the case of the various connection procedures have dissimilar sizes. The marking device can furthermore be configured in such a manner that the former can generate markings of various sizes by means of shape cutting, embossing, and/or laser machining.

According to a further embodiment, the various types of markings differ in terms of the shape thereof. For example, the marking device in the case of the various connection procedures can leave behind markings of dissimilar shapes on the fastening elements, such as, for example, in a circular shape, a star shape, a cruciform shape, a rectangular shape, a triangular shape, etc.

According to a further embodiment, the various types of markings differ in terms of the marking depth. Markings of dissimilar embossing depths or milling depths can be produced by way of the marking device, for example.

According to a further embodiment, the various types of markings differ in terms of the marking color. The marking device can have various marking units, for example, which are configured for generating markings by means of a marking indicator such as, for example, paint or lacquer, in various colors.

According to a further embodiment, the various types of markings differ in terms of the position thereof on the fastening elements. For example, the marking that is generated upon completion of the first connection procedure can be performed at a defined first position on the first fastening element, and the marking that is generated upon completion of the second connection procedure can be performed at a defined further position that is dissimilar to the first position. The various positions can be located on a screw head surface of a screw head, on a lateral wall of a screw head, or on an upper or lateral edge of a screw head, for example.

According to a further embodiment, the marking device has at least two marking units which are, in each case, configured for generating mutually dissimilar markings. The marking units can be configured as impact pins, for example, by which the fastening elements can be provided with an embossed marking. The embossed markings which are formed by the impact pins preferably differ in terms of the size, shape, embossing depth, and/or embossed position thereof. For example, the impact pins can be axially moved in a housing of the marking device by way of solenoids which can be connected to the impact pins by way of supply lines. Alternatively, the marking units can also be configured as milling cutter marking units, as paint marking units, or as laser marking units, for example. According to one further embodiment, the marking device apart from the two marking units has one further marking unit or a multiplicity of further marking units. The marking device preferably has at least three marking units which in each case can generate dissimilar markings. The marking device particularly preferably has four marking units for generating dissimilar markings.

According to a further embodiment, the fastening elements, after reaching a predefined torque and/or a predefined terminal angle, are provided with the markings in a fully automated manner.

According to a further embodiment, the assembly tool is configured as a screwdriver tool, wherein the marking device is integrated in a screwdriver head of the screwdriver tool. The marking device can be integrated in a screwdriver head of an electric hand-held screwdriver, for example.

According to a further embodiment, the assembly tool can have a housing in which the marking device is at least partially disposed. The marking units of the marking device can be completely accommodated in the housing. Signal processing of the marking device can also be performed outside the housing. A lower side of the housing can be configured as a receptacle of the fastening element. For example, the lower side of the housing can have the shape of a socket, for example of a hexagonal screw socket.

The assembly sequence, such as the screw connection sequence, for example, can be retrospectively tracked directly on a workpiece with the aid of the assembly tool described herein by way of the markings that are generated by the assembly tool. On account thereof, it can advantageously be checked by virtue of a deviation from the screw connection sequence whether there is a conceptual issue, such as a constructive issue, for example, a component quality issue, or a process issue in assembly in the case of a defective system, such as a leaking system, for example.

An assembly device which has an assembly tool as is presently described and a control unit is furthermore provided. The control unit is preferably connected to the marking device and controls the latter. The assembly tool of the assembly device can have one or a plurality of features of the assembly tool as has been previously described.

According to one further embodiment, the control unit in terms of program technology is connected to an assembly line. The assembly line can include a conveyor unit for conveying workpieces or components, respectively, for example. The control unit is preferably configured for receiving items of information pertaining to a commencement and/or a termination of a new assembly procedure or of a new assembly series, respectively, and to transmit said items of information to the marking device. It can be achieved on account thereof that the marking device can identify the start or the end, respectively, of a new screw connection series, for example.

A method for forming markings in fastening elements by use of an assembly tool is furthermore provided. The assembly tool that is employed herein can have one or a plurality of features of the aforementioned embodiments. The embodiments described above and hereunder apply equally to the assembly tool as well as to the method for forming markings by use of the assembly tool.

According to one embodiment, in the case of the method an assembly tool as described herein, at least one component, and a plurality of fastening elements are provided. A first fastening element is connected to the component via the assembly tool, wherein the first fastening element upon completion of the connection procedure is provided with a first type of marking. A second fastening element in a second connection procedure is subsequently connected to the component via the assembly tool, wherein the second fastening element upon completion of the second connection procedure is provided with a second type of marking. Providing the fastening elements with the markings is preferably performed in a fully automated manner.

According to one further embodiment, a dual system is used as the marking method in the case of the method. A marking device having four marking units which, in each case, generate mutually dissimilar types of markings such as described, for example, hereunder in the context of FIG. 3, can be employed herein, for example.

By way of the assembly tool described herein, or of the method for forming markings in fastening elements by way of the assembly tool, respectively, as described herein it can be advantageously achieved that after completion of an assembly procedure it is also possible to retrospectively establish whether a predefined assembly sequence such as, for example, a screw connection sequence, has been correctly adhered to. A screw connection sequence that has been correctly adhered to is important in the case of flange screw connections, for example, in order for a tight system to be guaranteed.

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 3 is a depiction of an exemplary marking method, employing a dual system according to one further exemplary embodiment.

DETAILED DESCRIPTION OF THE DRAWINGS

Same or functionally equivalent component parts can be provided with the same reference sign in the exemplary embodiments and figures. In principle, the elements illustrated and the mutual size ratios thereof are not to be considered as true to scale. Rather, individual elements can be illustrated so as to be dimensioned excessively thick or large for the sake of improved clarity and/or improved comprehension.

Figure 1:
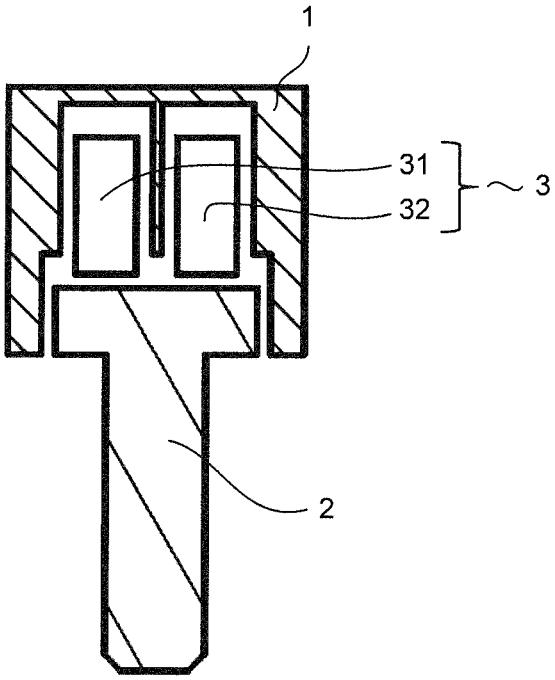
FIG. 1 is a schematic illustration of an assembly tool and of a fastening element according to one exemplary embodiment.

FIG. 1 shows a schematic illustration of an assembly tool 1 for connecting fastening elements 2 to a component (not illustrated), according to one exemplary embodiment. The assembly tool 1 has a marking device 3 which is configured for providing a first fastening element 2, which in the exemplary embodiment illustrated is configured as a screw, with a first type of marking upon completion of a first connection procedure, and providing a second fastening element 2 with a second type of marking upon completion of a subsequent second connection procedure. The marking device 3 in the exemplary embodiment illustrated has two marking units 31, 32 which are configured as impact pins.

The impact pins are mounted so as to be axially displaceable in a housing of the marking device 3 and are guided in this housing. The fastening element 2 can be provided with the markings by way of embossing via the impact pins. The impact pins thus function as embossing tools. The impact pins preferably generate markings of dissimilar shape and/or size. Alternatively or additionally, the impact pins can also generate markings of dissimilar depth. The assembly tool 1, by virtue of the dissimilar markings, can be used without any special prior alignment or orientation, respectively. Providing the fastening elements 2 with the markings is performed upon reaching a predefined nominal torque.

Supply lines and solenoids for moving the impact pins can furthermore be disposed in the housing of the marking device 3. The impact pins in a non-energized state are disposed so as to be movable in the guide. Should a solenoid be energized by a defined alternating voltage, the associated impact pin travels at a respective frequency in the axial direction. One solenoid and one supply line are preferably provided for each of the impact pins.

According to one alternative preferred exemplary embodiment, the assembly tool 1 has a marking device 3 having four marking units 31, 32 which in each case are configured as impact pins and in each case can generate mutually dissimilar markings.

Figure 2:
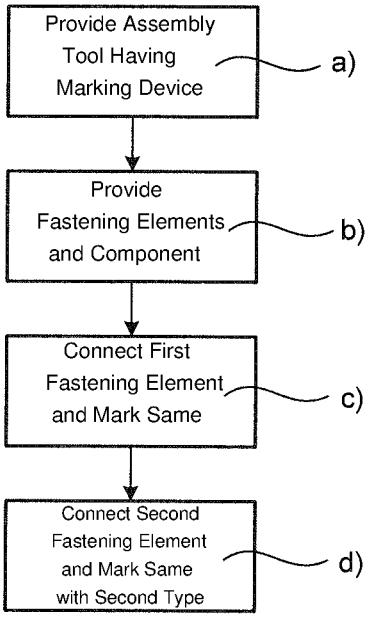
FIG. 2 is a schematic illustration of a method for forming markings in fastening elements, according to one further exemplary embodiment.

A schematic illustration of a method for forming markings in fastening elements according to one exemplary embodiment is shown in FIG. 2. In step (a), an assembly tool 1 which has a marking device 3 for forming various types of markings is provided. In step (b), a plurality of fastening elements 2 and at least one component are furthermore provided. In step (c), a first fastening element 2 is connected to the component by the assembly tool 1, wherein the marking device 3 upon completion of the connection procedure provides the first fastening element 2 with a first type of marking. Subsequent thereto in a method step (d), a second fastening element 2 is connected to the component by the assembly tool 1, wherein the marking device 3 upon completion of the connection procedure provides the second fastening element 2 with a second type of marking.

According to one further exemplary embodiment, further connection procedures in which further fastening elements 2 are connected to the component follow, wherein the marking device 3 of the assembly tool 1 upon completion of each of the connection procedures provides the respective fastening element 2 with further types of markings. The various types of markings herein each differ, in terms of the size, shape, depth, color, and/or position thereof, for example. Providing the fastening elements with the markings is, in each case, preferably performed in a fully automatic manner. For example, the marking device 3 can be connected to a control unit which controls the marking device 3 or the marking units 31, 32 of the marking device 3, respectively.

FIG. 3 shows a depiction of an exemplary marking method which can be employed in the case of the method described herein. A marking device 3 which has four marking units 31, 32 can be used herein, for example. The four marking units 31, 32 can in each case be configured as impact pins A, B, C, D, for example, wherein the impact pins can in each case generate mutually dissimilar types of markings in a fastening element.

No marking can thus be performed in the case of a first screw upon reaching a predefined torque, for example. In the case of the subsequent second screw, the latter is provided with a marking by means of the impact pin D. The third screw obtains a marking by the impact pin C, and the fourth screw is provided with a marking by both the impact pin C as well as by the impact pin D.

Sixteen different marking patterns can thus be achieved by way of the four impact pins A, B, C, D by using various combinations of the impact pins used in each case by means of the dual system illustrated in FIG. 3. Assembly sequences having up to sixteen individual connection procedures can thus be documented on account thereof.

According to further exemplary embodiments, the features that are described in the exemplary embodiments shown can also be combined with one another. Alternatively or additionally, the exemplary embodiments shown in the figures can have further features according to the embodiments of the general description.

LIST OF REFERENCE SIGNS

1 Assembly tool
2 Fastening element
3 Marking device
31, 32 Marking unit
A, B, C, D Impact pins The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

What is claimed is:

1. An assembly tool for connecting fastening elements to at least one component, the assembly tool comprising:

a marking device of the assembly tool, wherein the marking device of the assembly tool provides a fastening element with a first type of marking upon completion of a first connection procedure by assembly tool, the first connection procedure being a procedure in which the fastening element is connected to a first component, the marking device of the assembly tool provides a further fastening element with a second type of marking upon completion of a second connection procedure by the assembly tool, the second connection procedure being a procedure in which the further fastening element is connected to a further component, and the said marking device has at least two different marking units which are configured to produce different markings.

2. The assembly tool according to claim 1, wherein the markings are provided in a fully automated manner upon completion of the connection procedures.

3. The assembly tool according to claim 1, wherein the first type of marking differs from the second type of marking in terms of at least one of: size, shape, depth, color, or position thereof.

4. The assembly tool according to claim 1, wherein the marking device comprises two marking units configured to generate mutually dissimilar markings.

5. The assembly tool according to claim 1, wherein the marking device of the assembly tool is configured to provide one or more further types of markings upon completion of one or more further connection procedures.

6. The assembly tool according to claim 1, wherein the markings are shape cuts or embossings in the fastening elements.

7. The assembly tool according to claim 1, wherein the markings are generated via a laser beam.

8. The assembly tool according to claim 1, wherein the markings are generated by applying a marking indicator.

9. The assembly tool according to claim 8, wherein the marking indicator is a paint or lacquer application.

10. The assembly tool according to claim 1, wherein the completion of a connection procedure occurs upon reaching a predefined torque and/or terminal angle of the fastening element.

11. The assembly tool according to claim 1, wherein the assembly tool is a screwdriver.

12. The assembly tool according to claim 11, wherein the screwdriver is a hand-held screwdriver.

13. An assembly system, comprising:

an assembly tool according to claim 1; and a control unit operatively connected to the marking device of the assembly tool, wherein the control unit is configured to control the marking device.

14. The assembly system according to claim 13, wherein the control unit is coupled in terms of program technology to an assembly line.

15. A method of forming markings in fastening elements, the method comprising the acts of:

providing an assembly tool for connecting the fastening elements to at least one component, the assembly tool having a marking device configured to provide a fastening element with a first type of marking upon completion of a first connection procedure and a further fastening element with a second type of marking upon completion of second connection procedure;

providing at least one component and a plurality of the fastening elements;

connecting a first of the fastening elements to the component via the assembly tool, wherein the first fastening element is provided with the first type of marking upon completion of the first connection procedure by the assembly tool;

connecting a second of the fastening elements to the component via the assembly tool, wherein the second fastening element is provided with the second type of marking upon completion of the second connection procedure by the assembly tool, wherein the said marking device has at least two different marking units which are configured to produce different markings, the first connection procedure is a procedure in which the first of the fastening elements is connected to the component, and the second connections procedure is a procedure in which second of the fastening elements is connected to the component.

16. The method according to claim 15, wherein the provision of the first and second types of markings on the first and second fastening elements, respectively, is performed in a fully automated manner.

17. The method according to claim 15, wherein the method is a dual system marking method.

* * * * *